US012759836B2

(12) United States Patent
Lagace et al.

(10) Patent No.: US 12,759,836 B2
(45) Date of Patent: Oct. 13, 2026

(54) THREE PIECE WINDING REEL

(71) Applicant: Sonoco Development, Inc., Hartsville, SC (US)

(72) Inventors: Chad Lagace, Chatham, NY (US); Rick Sayers, Chatham, NY (US); Joshua Stall, Chatham, NY (US)

(73) Assignee: Sonoco Development, Inc., Hartsville, SC (US)

( * ) Notice: Subject to any disclaimer, the term of this patent is extended or adjusted under 35 U.S.C. 154(b) by 386 days.

(21) Appl. No.: 18/522,714

(22) Filed: Nov. 29, 2023

(65) Prior Publication Data

US 2025/0171268 A1 May 29, 2025

(51) Int. Cl.
*B65H 75/22* (2006.01)

(52) U.S. Cl.
CPC ..... *B65H 75/2281* (2021.05)

(58) Field of Classification Search
CPC ..... B65H 75/14; B65H 75/2281
See application file for complete search history.

(56) References Cited

U.S. PATENT DOCUMENTS

| | | | | |
|---|---|---|---|---|
| 3,339,861 | A | 9/1967 | Montesi | |
| 4,428,546 | A | 1/1984 | Weideman | |
| 5,718,397 | A | 2/1998 | Stevens | |
| 5,775,634 | A | 7/1998 | Fettes et al. | |
| 6,305,639 | B1 | 10/2001 | Bocciola | |
| 6,676,069 | B1 * | 1/2004 | Davis | B65H 75/146 242/608.5 |
| 6,702,228 | B2 | 3/2004 | Zide et al. | |
| 6,736,349 | B1 | 5/2004 | Boisdon et al. | |
| 7,108,222 | B1 | 9/2006 | Schaefer | |
| 7,237,746 | B2 | 7/2007 | Couchey et al. | |
| 7,614,582 | B2 | 11/2009 | Haefner | |

(Continued)

FOREIGN PATENT DOCUMENTS

| | | |
|---|---|---|
| DE | 8902938 U1 | 5/1989 |
| DE | 4202218 C2 | 9/1994 |

(Continued)

OTHER PUBLICATIONS

International Search Report and Written Opinion for International Application PCT/US2024/054504; Dated Feb. 13, 2025; 18 pages.

*Primary Examiner* — William A. Rivera
(74) *Attorney, Agent, or Firm* — Nelson Mullins Riley & Scarborough LLP

(57) ABSTRACT

The present disclosure is directed to an industrial reel. The industrial reel may include a spool comprising a cylindrical hub, a first spool flange positioned at a first end of the cylindrical hub and a second spool flange positioned at a second end of the cylindrical hub. The industrial reel may further include at least one first insert removably affixable to the first spool flange. The at least one first insert may include a first cylindrical barrel having a first longitudinal end and a second longitudinal end, the second longitudinal end includes at least one or more castellations. The at least one first insert further includes a first insert flange extending from the first longitudinal end of the first cylindrical barrel, the first insert flange is removably affixable on a radially outward edge thereof to a radially outward edge of the first spool flange.

27 Claims, 6 Drawing Sheets

(56) References Cited

U.S. PATENT DOCUMENTS

| | | | | |
|---|---|---|---|---|
| 10,549,944 | B2 | 2/2020 | Ishikawa et al. | |
| 10,584,012 | B2 | 3/2020 | Nilsson et al. | |
| 2004/0206850 | A1* | 10/2004 | Hafner | B29C 66/54 242/609.4 |
| 2008/0061187 | A1 | 3/2008 | Couchey et al. | |
| 2024/0359944 | A1* | 10/2024 | Nichols | B65H 75/2272 |
| 2024/0400343 | A1* | 12/2024 | Nichols | B65H 75/14 |
| 2024/0417210 | A1* | 12/2024 | Brown | B29C 66/522 |
| 2025/0368472 | A1* | 12/2025 | Nichols | B65H 75/2227 |

FOREIGN PATENT DOCUMENTS

| | | | |
|---|---|---|---|
| DE | 102014109295 | B3 | 1/2016 |
| WO | 2003042084 | A1 | 5/2003 |

* cited by examiner

THREE PIECE WINDING REEL

FIELD OF THE DISCLOSURE

The present disclosure relates generally to improved systems and methods for industrial reels, and more particularly, to an improved assembly, disassembly and locking mechanism for industrial reels.

BACKGROUND OF THE DISCLOSURE

In general, industrial reels often include a barrel and two flanges which connect to the barrel. Industrial materials such as wire, cable, tubing, rope, yarn, or the like may be wound onto the barrel of the reel. The reel can be taken apart (i.e., the flanges removed from the barrel) during shipping or after use, for example, to conserve space and minimize shipping costs.

Typically, industrial reels are assembled using a chemical solvent that is hazardous to people and the environment. In other cases, the flanges and barrel of the reels twist and lock together with integral holding snaps on the flange that are very stiff in order to maintain the barrel/flange connection during winding and unwinding. To remove the flanges from the barrel, a user must lift the snaps that lock the reel parts together, often using a specialized tool to pry the snap away from the barrel because the force required to lift the snaps is greater than can be achieved manually with a finger. This is undesirable because users generally prefer to avoid purchasing, managing, and using special tools where possible.

Through ingenuity and hard work, the inventors have developed an industrial three-piece reel having an efficient and effortless locking and alignment mechanism located on the barrel and at least one of the flanges of the reel that does not require the need for chemicals or a specialized tool to assemble, disassemble and/or lock.

BRIEF SUMMARY OF THE DISCLOSURE

In an embodiment, the invention comprises an industrial reel having a spool comprising a cylindrical hub, a first spool flange positioned at a first end of the cylindrical hub and a second spool flange positioned at a second end of the cylindrical hub, the first spool flange and the second spool flange projecting radially from the cylindrical hub. The industrial reel further includes at least one first insert removably affixable to the first spool flange. The at least one first insert comprises a first cylindrical barrel having a first longitudinal end and a second longitudinal end, wherein the second longitudinal end includes at least one or more castellations. The at least one first insert further comprises a first insert flange extending from the first longitudinal end of the first cylindrical barrel, wherein the first insert flange is removably affixable on a radially outward edge thereof to a radially outward edge of the first spool flange.

In an embodiment, the reel further comprises a second insert removably affixable to the second spool flange. The second insert includes a second cylindrical barrel having a first longitudinal end and a second longitudinal end, wherein the second longitudinal end includes at least one or more castellations. The second insert further includes a second insert flange extending from the first longitudinal end of the second cylindrical barrel, wherein the second insert flange is removably affixable on a radially outward edge thereof to a radially outward edge of the second spool flange. In an embodiment, the first cylindrical barrel of the first insert and the second cylindrical barrel of the second insert are partial barrels.

In an embodiment, the radially outward edge of the first spool flange and the radially outward edge of the second spool flange each comprise a sidewall that is perpendicular to an inner surface of the first spool flange and the second spool flange. In an embodiment, the spool further comprises at least one or more slots positioned within the sidewall of the first spool flange and the second spool flange. In an embodiment, the radially outward edge of the first insert flange and the radially outward edge of the second insert flange each comprise at least one or more insert tabs configured to interlock with the one or more slots.

In an embodiment, the reel further comprises a locking mechanism. In an embodiment, the locking mechanism includes at least one or more insert tabs of the first insert flange locking into at least one or more slots of the first spool flange and at least one or more insert tabs of the second insert flange locking into at least one or more slots of the second spool flange. In an embodiment, an exterior surface of the cylindrical hub forms a barrel surface for receipt of a wire for winding thereon.

In an embodiment, the at least one or more castellations of the first and the second insert create an alignment feature to lock the first and the second inserts into each other. In an embodiment, the at least one or more castellations of the first and the second insert comprise a series of recessed castellations and a series of extending castellations. In an embodiment, the recessed castellations of the first insert are configured to be aligned with the extending castellations of the second insert, and the recessed castellations of the second insert are configured to be aligned with the extending castellations of the first insert. In an embodiment, the first and the second inserts are locked into each other and extend through an interior surface of the cylindrical hub.

In an embodiment, the first and the second spool flange each further comprise at least one or more ribs protruding from the sidewall of the first and the second spool flange and extending to the inner surface of the first and the second spool flange. In an embodiment, a location of the at least one or more slots on the sidewall of the first and the second spool flange does not include the at least one or more ribs protruding from the same location on the sidewall. In an embodiment, the at least one or more ribs prevent the at least one or more insert tabs of the first and the second insert from snapping into the spool except in the at least one or more slots of the first and the second spool flange.

In an embodiment, the invention comprises a locking system for an industrial reel having a spool comprising a cylindrical hub, a first spool flange positioned at a first end of the cylindrical hub and a second spool flange positioned at a second end of the cylindrical hub, the first spool flange and the second spool flange projecting radially from the cylindrical hub. The locking system further comprises a first insert and a second insert removably affixable to the first spool flange and the second spool flange respectively. The first insert and the second insert each comprise a cylindrical barrel having a first longitudinal end and a second longitudinal end, wherein the second longitudinal end includes at least one or more castellations. The first insert and the second insert each further comprise an insert flange extending from the first longitudinal end of the cylindrical barrel, wherein the insert flange is removably affixable on a radially outward edge thereof to a radially outward edge of the first spool flange.

In an embodiment, the first cylindrical barrel of the first insert and the second cylindrical barrel of the second insert are partial barrels. In an embodiment, the radially outward edge of the first spool flange and the radially outward edge of the second spool flange each comprise a sidewall that is perpendicular to an inner surface of the first spool flange and the second spool flange. In an embodiment, the spool further comprises at least one or more slots positioned within the sidewall of the first spool flange and the second spool flange. In an embodiment, the radially outward edge of the first insert flange and the radially outward edge of the second insert flange each comprise at least one or more insert tabs configured to interlock with the one or more slots.

In an embodiment, the reel further comprises a locking mechanism. In an embodiment, the locking mechanism includes at least one or more insert tabs of the first insert flange locking into at least one or more slots of the first spool flange and at least one or more insert tabs of the second insert flange locking into at least one or more slots of the second spool flange. In an embodiment, an exterior surface of the cylindrical hub forms a barrel surface for receipt of a wire for winding thereon.

In an embodiment, the at least one or more castellations of the first and the second insert create an alignment feature to lock the first and the second inserts into each other. In an embodiment, the at least one or more castellations of the first and the second insert comprise a series of recessed castellations and a series of extending castellations. In an embodiment, the recessed castellations of the first insert are configured to be aligned with the extending castellations of the second insert, and the recessed castellations of the second insert are configured to be aligned with the extending castellations of the first insert. In an embodiment, the first and the second inserts are locked into each other and extend through an interior surface of the cylindrical hub.

In an embodiment, the first and the second spool flange each further comprise at least one or more ribs protruding from the sidewall of the first and the second spool flange and extending to the inner surface of the first and the second spool flange. In an embodiment, a location of the at least one or more slots on the sidewall of the first and the second spool flange does not include the at least one or more ribs protruding from the same location on the sidewall. In an embodiment, the at least one or more ribs prevent the at least one or more insert tabs of the first and the second insert from snapping into the spool except in the at least one or more slots of the first and the second spool flange.

In an embodiment, the invention discloses a method for locking and unlocking an industrial reel. The method comprises providing a spool comprising a cylindrical hub, a first spool flange positioned at a first end of the cylindrical hub and a second spool flange positioned at a second end of the cylindrical hub, the first spool flange and the second spool flange projecting radially from the cylindrical hub. The method further comprises providing at least one first insert removably affixable to the first spool flange. The at least one first insert includes a first cylindrical barrel having a first longitudinal end and a second longitudinal end, wherein the second longitudinal end includes at least one or more castellations. The at least one first insert further includes a first insert flange extending from the first longitudinal end of the first cylindrical barrel, wherein the first insert flange is removably affixable on a radially outward edge thereof to a radially outward edge of the first spool flange. The method further comprises locking at least one or more insert tabs of the first insert flange into at least one or more slots of the first spool flange.

In an embodiment, the reel further comprises providing a second insert removably affixable to the second spool flange. The second insert comprises a second cylindrical barrel having a first longitudinal end and a second longitudinal end, wherein the second longitudinal end includes at least one or more castellations. The second insert further comprises a second insert flange extending from the first longitudinal end of the second cylindrical barrel, wherein the second insert flange is removably affixable on a radially outward edge thereof to a radially outward edge of the second spool flange. In an embodiment, the method further comprises locking at least one or more insert tabs of the second insert flange into at least one or more slots of the second spool flange. In an embodiment, the method also comprises aligning the at least one or more castellations of the first and the second insert into each other.

BRIEF DESCRIPTION OF THE SEVERAL VIEWS OF THE DRAWING(S)

Having thus described the present disclosure in general terms, reference will now be made to the accompanying drawings, which are not necessarily drawn to scale, and wherein:

DETAILED DESCRIPTION OF THE DISCLOSURE

Figure 1:
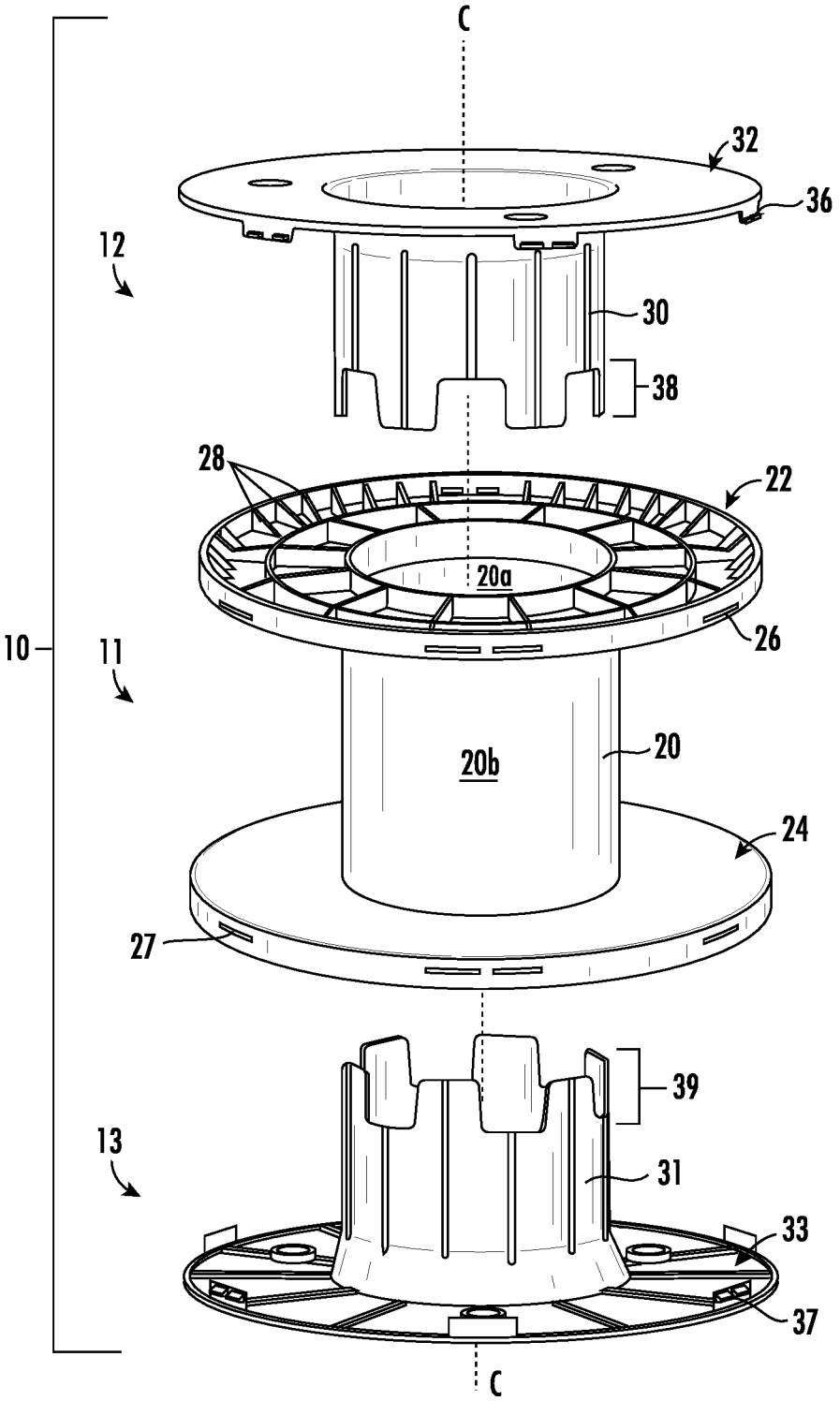
FIG. 1 is an exploded perspective view of a reel having features contemplated by the present invention, in accordance with some embodiments of the present disclosure.

While this present disclosure may be embodied in many forms, there is shown in the drawings and will herein be described in detail one or more embodiments, with the understanding that this disclosure is to be considered an exemplification of the principles of the present disclosure and is not intended to limit the disclosure to the illustrated embodiments.

Generally speaking, the present invention is directed to an industrial reel, defined by a barrel, or hub, having a central axis, an interior surface and an exterior surface, the exterior surface forming a barrel surface for receipt of a wire, a cable, or the like for winding thereon. The hub, in an embodiment, has a flange disposed at each longitudinal end. The reel has at least one first insert formed separately from the spool. In a particular embodiment, the reel has two inserts formed separately from the spool, each of which can be inserted into an opposite end of the hub and locked into position with each flange.

In one aspect of the present invention, the industrial reel includes a locking mechanism. In an embodiment, the locking mechanism includes at least one or more insert tabs positioned on the at least one first insert, configured for locking into at least one or more slots positioned on a first flange of the spool. In an embodiment, other types of locking mechanisms are contemplated. In another aspect of the present invention, the industrial reel further includes an alignment mechanism between the at least one first insert and a second insert. In an embodiment, the alignment mechanism allows the first and the second insert to lock into each other through the interior surface of the spool hub. The spool and/or insert(s) may comprise integrally molded thermoplastic material and the spool hub may be substantially centrally hollow, the hollow portion defined by the interior surface of the winding surface.

Other features of the present invention and combinations of features will become apparent from the detailed description below, taken in conjunction with the accompanying drawings.

FIG. 1 illustrates an exploded view of an industrial reel 10 along a central axis (C). In an embodiment, the reel 10 includes a spool 11 having a cylindrical hub 20. The cylindrical hub 20 includes an interior surface 20*a* defining a central hollow bore through a center of the hub 20 and an exterior surface 20*b* concentrically formed with the interior surface 20*a* (see FIG. 2). In some embodiments, the exterior surface 20*b* of the cylindrical hub 20 forms a surface for receipt of a wire (not shown) for winding thereon. In an embodiment, the spool 11 further includes a first spool flange 22 positioned at a first end 20*c* of the cylindrical hub 20 and a second spool flange 24 positioned at a second end 20*d* of the cylindrical hub 20. In an embodiment, the first spool flange 22 and the second spool flange 24 project radially from the cylindrical hub 20 of the spool 11. While a first spool flange 22 and a second spool flange 24 are shown in the figures, in some embodiments, a functional spool 11 may include only a single flange, if desired. Additionally, it should be understood that in a two-flange construction, each flange will be formed in a similar fashion, as will each end of the cylindrical hub 20. In an embodiment, the cylindrical hub 20 is contemplated to be integrally molded. Similarly, the structure of each flange may have an integrally molded construction. The hub 20 and flange may be integrally molded, in an embodiment.

Figure 3A:
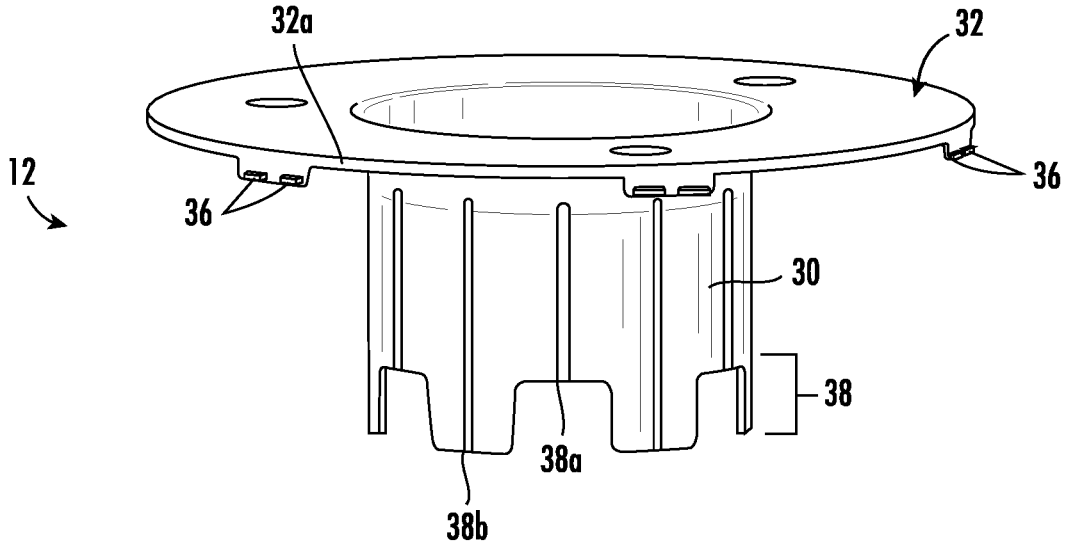
FIGS. 3A-3B are perspective views of a first and second insert of the reel in FIG. 1, in accordance with some embodiments of the present disclosure.

As depicted in FIGS. 1 and 3A, the reel 10 further includes at least one first insert 12 removably affixable to the first spool flange 22 of the spool 11. In an embodiment, the at least one first insert 12 comprises a first cylindrical barrel 30 having a first longitudinal end and a second longitudinal end, in which the second longitudinal end includes at least one or more castellations 38. In some embodiments, the first cylindrical barrel 30 is a partial barrel. In other embodiments, the first cylindrical barrel 30 is less than or about half the size of the cylindrical hub 20 of the spool 11. Additionally, in an embodiment, the at least one first insert 12 further includes a first insert flange 32 extending from the first longitudinal end of the first cylindrical barrel 30. In an embodiment, the first insert flange 32 is removably affixable on a radially outward edge thereof to a radially outward edge of the first spool flange 22.

Figure 3B:
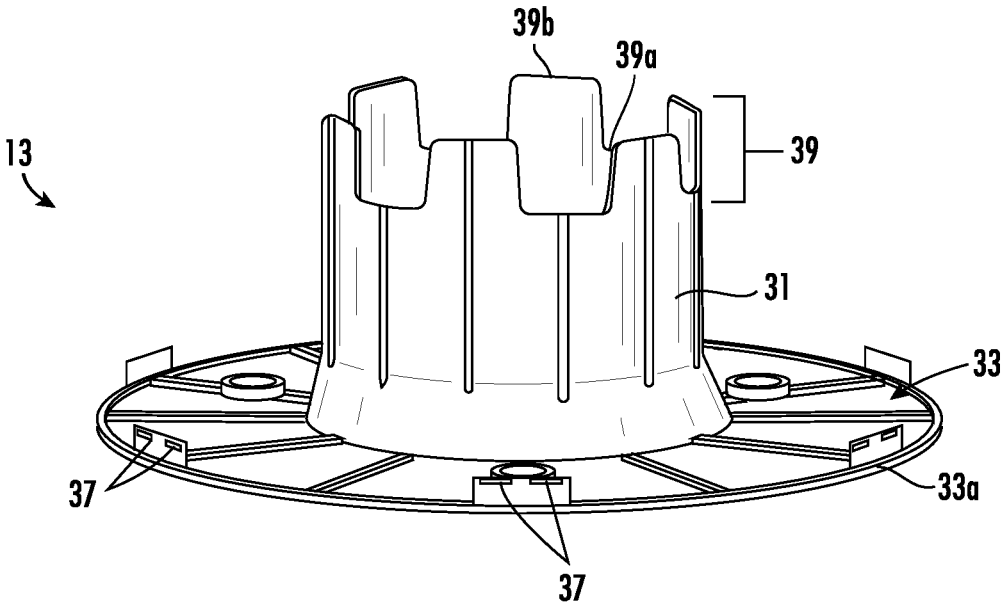

In an embodiment, as depicted in FIGS. 1 and 3B, the industrial reel 10 further includes a second insert 13 removably affixable to the second spool flange 24. In an embodiment, the second insert 13 includes a second cylindrical barrel 31 having a first longitudinal end and a second longitudinal end, the second longitudinal end including at least one or more castellations 39. In some embodiments, the second cylindrical barrel 31 is a partial barrel. In other embodiments, the second cylindrical barrel 31 is less than or about half the size of the cylindrical hub 20 of the spool 11. In an embodiment, the second insert 13 further includes a second insert flange 33 extending from the first longitudinal end of the second cylindrical barrel 31, the second insert flange 33 being removably affixable on a radially outward edge thereof to a radially outward edge of the second spool flange 24.

While two inserts 12, 13 are shown in the figures, in some embodiments, a functional reel 10 may include only a single insert having a cylindrical barrel and an insert flange removably affixable to a spool flange, if desired. Additionally, as shown in FIG. 3B, it should be understood that in a two-insert construction, each insert may be formed in a similar fashion. In other embodiments, however, the two inserts may vary in construction depending on the desired use of the industrial reel 10.

Figure 2:
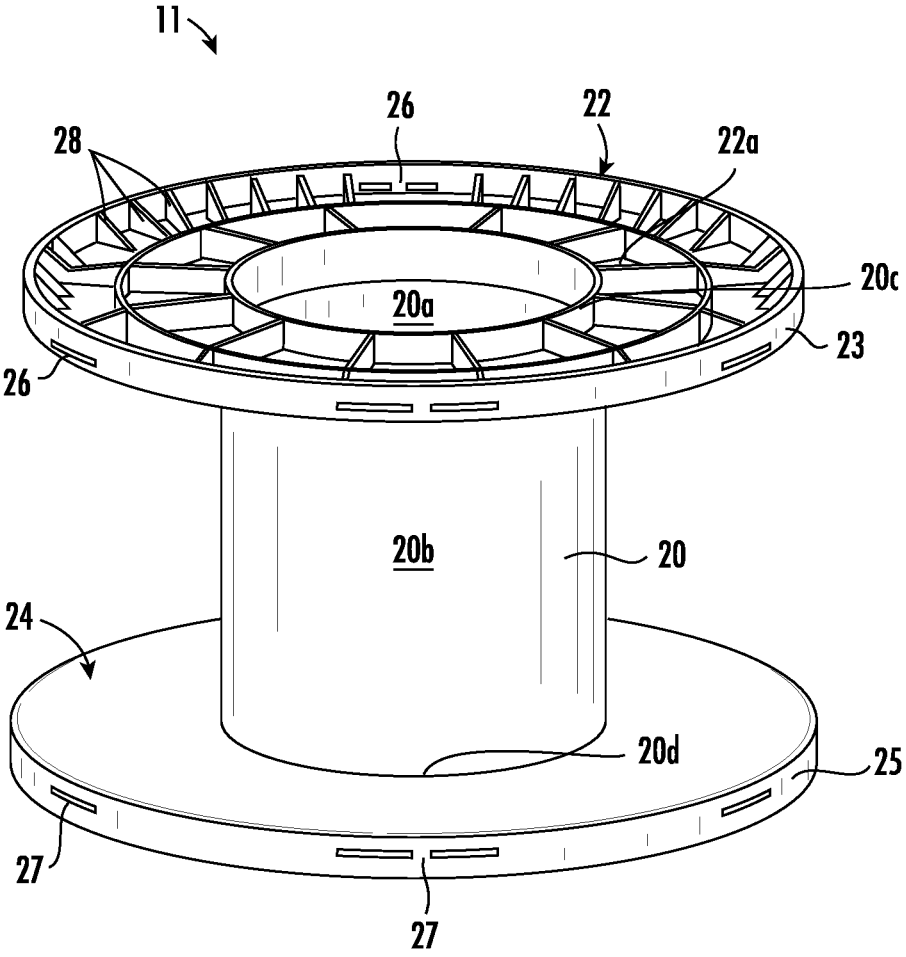
FIG. 2 is a perspective view of a spool of the reel in FIG. 1, in accordance with some embodiments of the present disclosure.

In some embodiments, the radially outward edge of the first spool flange 22 comprises a sidewall 23 that is perpendicular to an inner surface 22*a* of the first spool flange 22 (see FIG. 2). In other embodiments, the radially outward edge of the second spool flange 24 comprises a sidewall 25 that is perpendicular to an inner surface (not shown) of the second spool flange 24. In some embodiments, the spool 11 further includes at least one or more slots 26, 27 positioned within the sidewalls 23, 25 of the first spool flange 22 and the second spool flange 24. In some embodiments, the at least one or more slots 26, 27 may be molded into, cut into or carved onto the sidewalls 23, 25 of the first spool flange 22 and the second spool flange 24. The height of the sidewalls 23, 25 may be as high as necessary to fit the one or more slots 26, 27 and the radially outward edge of the first insert flange 32 and the second insert flange 33. In certain embodiments, the spool 11 may include as many slots as needed depending on the desired use of the industrial reel 10. In an embodiment, the configuration of the one or more slots 26, 27 may be a through hole, i.e., a clearance hole, (see FIG. 2), while in other embodiments, the one or more slots 26, 27 may extend only partially through the thickness of the sidewalls 23, 25 of the first and the second spool flange 22, 24. In an embodiment, the shape of the one or more slots 26, 27 may be square, rectangular, triangular, circular, ovular, elliptical or any other shape known in the art. In an embodiment, the slots are aligned along the sidewalls 23, 25, but could alternatively be offset from one another. In an embodiment, the slots 26, 27, are sized, shaped, oriented, and configured to receive the tabs 36, 37, described below.

In an embodiment, the radially outward edge of the first insert flange 32 and the radially outward edge of the second insert flange 33 each comprise a sidewall 32*a*, 33*a*, that is perpendicular to an inner surface of the insert flange 32, 33. Additionally, in an embodiment, the sidewalls 32*a*, 33*a* each comprise at least one or more insert tabs 36, 37. In certain embodiments, the at least one or more insert tabs 36 of the first insert flange 32 is configured to interlock with the one or more slots 26 positioned within the sidewall 23 of the first spool flange 22. In certain embodiments, the at least one or more insert tabs 37 of the second insert flange 33 is configured to interlock with the one or more slots 27 positioned within the sidewall 25 of the second spool flange 24.

Figure 4:
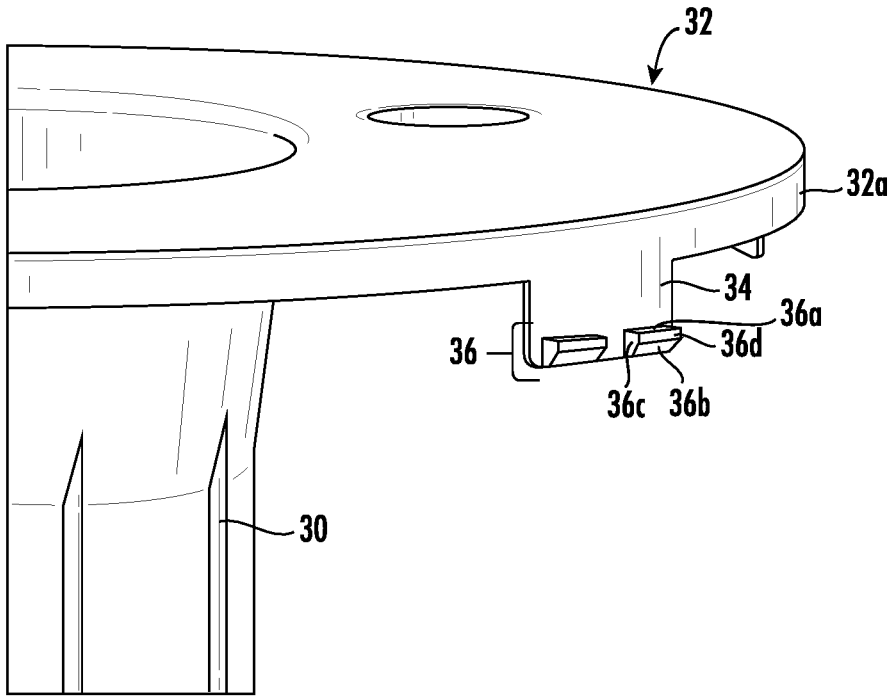
FIG. 4 is a perspective close-up view of an insert tab positioned on an extension element, in accordance with some embodiments of the present disclosure.

In an embodiment, the shape of the at least one or more insert tabs 36, 37 may be generally square, rectangular, triangular, ovular, circular, elliptical, a combination thereof, or any other shape known in the art. While in the figures the at least one or more insert tabs 36, 37 are depicted as having two side-by-side insert tabs, in certain embodiments there may only be one insert tab, while in other embodiments there may be multiple insert tabs disposed on the sidewalls 32*a*, 33*a*. In some embodiments, as shown in FIG. 4, the at least one or more insert tabs 36, 37 may be positioned on one or more extension elements 34 which extend parallel with the sidewalls 32*a*, 33*a* of the first and the second insert flange 32, 33. In these embodiments, the at least one or more insert tabs 36, 37 may extend radially outward from the extension element 34. In an embodiment, the extension elements 34 may be flexible, in that the extension elements 34 can flex upon introduction to the sidewall 23 of the first spool flange 22. In an embodiment, the extension elements 34 may be biased toward an outward configuration, as shown in the figures, but may flex inwardly, toward the central axis, upon application of force or insertion into the first spool flange 22.

In an embodiment, each of the at least one or more insert tabs 36, 37 may include at least one of an upper face 36*a*, a lower face 36*b*, two side faces 36*c* and, optionally, a forward face 36*d*. In some embodiments, the lower face 36*b* may be curved or angled such that the lower face 36*b* directs the tab 36 into a respective slot. In this embodiment, the lower face 36*b* may contact the inner surface of sidewall 23 in an interference fit and slide along said inner surface until reaching the slot 26. The lower face 36*b* may then slide into the slot 26 until such time as the upper face 36*a* of the tab 36 enters the slot 26. In an embodiment, the configuration of the upper face 36*a* does not permit removal of the tab 36 from the slot 26 without the application of external forces. That is, in an embodiment, the upper face 36*a* of the tab 36 may be flat and may interface with an upper edge of the slot 26. In an embodiment, an audible click may be observed upon locking of the insert tab 36 into the slot 26, as the tab 36 flexes back to its original biased configuration and contacts the sidewall 23 of the first spool flange 22. In some embodiments, the at least one or more insert tabs 36, 37 may include any configuration of the at least one of the upper face 36*a*, the lower face 36*b*, the two side faces 36*c* and the forward face 36*d*.

In certain embodiments, the first insert flange 32 and the second insert flange 33 may include as many insert tabs as necessary depending on the desired use of the industrial reel 10. In some embodiments, the more slots and insert tabs placed on the spool 11 and inserts 12, 13 of the reel 10, the more secure the locking mechanism of the reel 10 may be, as described in greater detail below. While in the figures the at least one or more slots 26, 27 and the at least one or more insert tabs 36, 37 are rectangular in shape, the at least one or more slots 26, 27 and the at least one or more insert tabs 36, 37 may be circular, triangular, or any other shape desired. In some embodiments, the shape and configuration of the at least one or more slots 26, 27 positioned within the sidewalls 23, 25 may match the shape of the at least one or more insert tabs 36, 37.

In some embodiments, at least one or more slots may be positioned on the radially outward edge of the first insert flange 32 and the radially outward edge of the second insert flange 33, while at least one or more insert tabs may be positioned on the sidewall of the first spool flange 22 and the second spool flange 24. In further embodiments, the one or more slots 26, 27 and the one or more insert tabs 36, 37 may be placed on another location on the reel 10 other than the first and the second spool flange 22, 24 and the first and the second insert flange 32, 33. In certain embodiments, for example, at least one or more slots may be positioned within the inner surface 20*a* of the cylindrical hub 20 near the first and the second end of the cylindrical hub 20*c*, 20*d* while at least one or more insert tabs may be placed on an inner surface of the first and the second cylindrical barrels 30, 31 of the first and the second insert 12, 13. In other embodiments, the spool 11 may comprise both at least one or more slots and at least one or more insert tabs while the first and the second inserts 12, 13 may also include the same counterparts, i.e., a slot interlocking with an insert tab and insert tab interlocking with a slot.

In an embodiment, the industrial reel includes a locking mechanism. In certain embodiments, the locking mechanism includes the at least one or more insert tabs 36 of the first insert flange 32 locking into the at least one or more slots 26 of the first spool flange 22 (see FIG. 4) and the at least one or more insert tabs 37 of the second insert flange 33 locking into the at least one or more slots 27 of the second spool flange 24. In other embodiments, only one insert and one spool flange may include the locking mechanism above while the other insert and spool flange of the reel 10 may include another form of locking mechanism. Further, while the locking mechanism is shown as a slot/tab connection, any locking mechanism means, such as a latch, hook and loop, chemically bonding an insert to a spool flange, a sliding lock mechanism, etc., known in the art could be utilized herein.

As depicted in FIG. 4, in an embodiment, the at least one or more castellations 38, 39 of the first and the second insert 12, 13 create an alignment feature to align and/or lock the first and the second inserts 12, 13 into each other. In some embodiments, the alignment feature comprises at least one or more castellations 38, 39 of the first and the second inserts 12, 13 comprising a series of recessed castellations 38*a*, 39*a* and a series of extending castellations 38*b*, 39*b*. In certain embodiments, the recessed castellations 38*a* of the first insert 12 are configured to be aligned with the extending castellations 39*b* of the second insert 13, and the recessed castellations 39*a* of the second insert 13 are configured to be aligned with the extending castellations 38*b* of the first insert 12. In certain embodiments, the alignment feature described creates a second locking mechanism for the reel 10. If the first and the second inserts 12, 13 are not aligned by their respective one or more castellations 38, 39, the first and the second inserts 12, 13 cannot install into each other and therefore the reel 10 as a whole will not lock into place. In an embodiment, the shape of the at least one or more castellations 38, 39 may be square, rectangular, triangular, elliptical or any other shape known in the art. Thus, in some embodiments, any shape known in the art may be contemplated for the recessed castellations 38*a*, 39*a* and the extending castellations 38*b*, 39*b*.

In an embodiment, when the at least one or more castellations 38, 39 of the first insert and the second insert 12, 13 align, the first insert 12 and the second insert 13 are able to lock into each other and extend through the interior surface 20*a* of the cylindrical hub 20. Thus, the diameter of the first cylindrical barrel 30 and the second cylindrical barrel 31 is smaller than the diameter of the cylindrical hub 20 of the spool 11, so that the first cylindrical barrel 30 of the first insert 12 may lock into the second cylindrical barrel 31 of the second insert 13 and extend through the interior surface 20*a* of the cylindrical hub 20.

Furthermore, in an embodiment, the first spool flange 22 and the second spool flange 24 each further comprise at least one or more ribs 28 protruding from the sidewalls 23, 25 of the first and the second spool flange 22, 24 and extending to the inner surface of the first and the second spool flange 22, 24 (see FIG. 2). Additionally, in locations in which the at least one or more slots 26, 27 are located within the sidewalls 23, 25 of the first and the second spool flange 22, 24, the specified location does not also include the at least one or more ribs 28 protruding from the sidewalls 23, 25, in an embodiment. In certain embodiments, this is because the at least one or more ribs 28 prevent the at least one or more insert tabs of the first and the second spool from snapping into the first and the second spool flange 22, 24 except in the location within the sidewalls 23, 25 having the at least one or more slots 26, 27 (see FIG. 4). In some embodiments, the at least one or more ribs 28 may extend all the way to the first and the second end of the cylindrical hub 20*c*, 20*d*, while in other embodiments, the at least one or more ribs 28 may extend only halfway on the inner surface of the first and the second spool flange 22, 24. In certain embodiments, the at least one or more ribs 28 may provide additional strength to the first and the second spool flange 22, 24.

Figure 5:
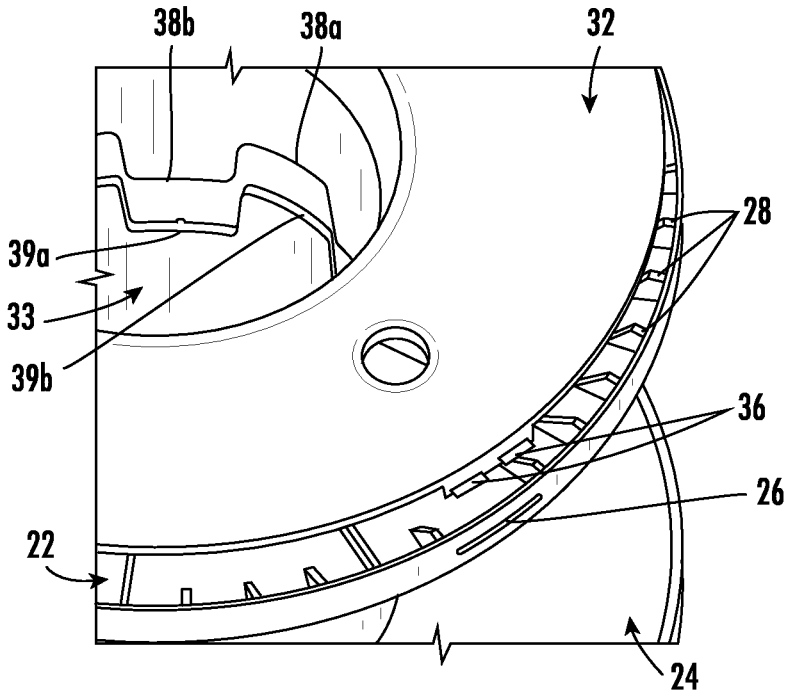
FIG. 5 is a top close-up view of the first insert locking into the spool and aligning with a second insert, in accordance with some embodiments of the present disclosure.
Figure 6:
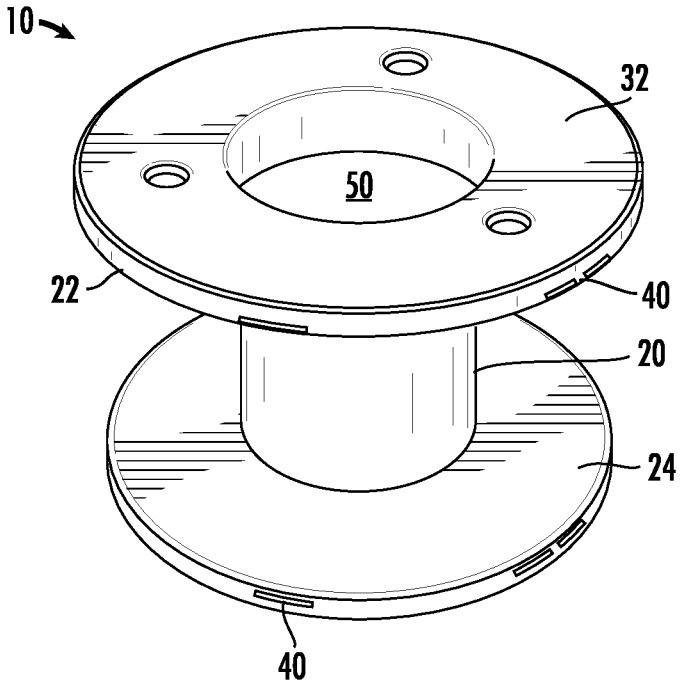
FIG. 6 is a perspective view of an assembled industrial reel, in accordance with some embodiments of the present disclosure.

FIG. 4 illustrates the locking mechanism and the alignment feature of the reel 10. In some embodiments, the first and the second inserts 12, 13 must align and the first and the second insert flange 32, 33 must lock into the first and the second spool flange 22, 24 in order for the reel 10 to be assembled. In some embodiments, the reel 10 may only require the alignment feature while in other embodiments the reel 10 may only require the locking mechanism in order to be assembled. FIG. 5 illustrates an assembled industrial reel 10 once it is in an aligned position 50 and in a locked position 40. In some embodiments, various holes or openings may be provided on the first and the second insert flange 32, 33 (see FIG. 5). In these embodiments, the openings may provide gripping mechanism for handling the reel 10 during use, assembly and/or disassembly.

In an embodiment, the at least one or more insert tabs 36, 37 may be removed from the at least one or more slots 26, 27, and thus the first and the second insert flange 32, 33 may be detached from the first and the second spool flange 22, 24, in order to, for example, disassemble the reel 10. In an embodiment, once the at least one or more insert tabs 36, 37 have locked into the at least one or more slots 26, 27 a user may insert the top of his finger, or even a fingernail, near the top of the sidewalls 32*a*, 33*a* and apply pressure inwardly, towards the central axis, in order to move the at least one or more insert tabs 36, 37 towards the central axis of the first and the second insert 12, 13. In some embodiments, once the at least one or more insert tabs 36, 37 have been moved far enough inwardly so that the at least one or more insert tabs 36, 37 is no longer in contact with the at least one or more slots 26, 27, the user may then lift the first and the second insert flange 32, 33 upward to detach the first and the insert 12, 13 from the first and the second spool flange 22, 24, and thus the spool 11. In some embodiments, the same motion may be applied to at least one or more insert tabs positioned on the extension elements 34. In other embodiments, when in a locked position, the at least one or more insert tabs 36, 37 may protrude out of the at least one or more slots 26, 27. Thus, in these embodiments, to detach the one or more insert tabs 36, 37 from the one or more slots 26, 27 the user may apply pressure using his fingers at the location of the protruded insert tabs to move the at least one or more insert tabs 36, 37 inwardly, towards the central axis and remove the at least one or more insert tabs 36, 37 from the one or more slots 26, 27.

In an embodiment, the structures of the present invention be formed with a minimum number of parts. Thus, in an embodiment, the completed reel 10 may have a single insert flange and spool flange. The elements of the reel 10 are also contemplated to be injection molded from a thermoplastic material, such as styrene, an olefin or combination of polymer materials. Further, the structures of the cylindrical hub 20, and the first and the second insert flange 32, 33 may be integrally molded. The surfaces and structural elements of the molded parts may be arranged to allow for withdraw of the mold sections from the parts with a minimum of movements and mold sections.

Many modifications and other embodiments of the present disclosure set forth herein will come to mind to one skilled in the art to which the present disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An industrial reel, the industrial reel comprising:

a spool comprising a cylindrical hub, a first spool flange positioned at a first end of the cylindrical hub and a second spool flange positioned at a second end of the cylindrical hub, the first spool flange and the second spool flange projecting radially from the cylindrical hub; and at least one first insert removably affixable to the first spool flange, the at least one first insert comprising:

a first cylindrical barrel having a first longitudinal end and a second longitudinal end, wherein the second longitudinal end includes at least one or more castellations; and a first insert flange extending from the first longitudinal end of the first cylindrical barrel, wherein the first insert flange is removably affixable on a radially outward edge thereof to a radially outward edge of the first spool flange;

a second insert removably affixable to the second spool flange, the second insert comprising:

a second cylindrical barrel having a first longitudinal end and a second longitudinal end, wherein the second longitudinal end includes at least one or more castellations; and a second insert flange extending from the first longitudinal end of the second cylindrical barrel, wherein the second insert flange is removably affixable on a radially outward edge thereof to a radially outward edge of the second spool flange;

wherein the radially outward edge of the first spool flange and the radially outward edge of the second spool flange each comprise a sidewall that is perpendicular to an inner surface of the first spool flange and the second spool flange;

wherein the spool further comprises at least one or more slots positioned within the sidewall of the first spool flange and the second spool flange; and wherein the radially outward edge of the first insert flange and the radially outward edge of the second insert flange each comprise at least one or more insert tabs configured to interlock with the one or more slots.

2. The industrial reel of claim 1, wherein the first cylindrical barrel of the first insert and the second cylindrical barrel of the second insert are partial barrels.

3. The industrial reel of claim 1, wherein the reel further comprises a locking mechanism.

4. The industrial reel of claim 3, wherein the locking mechanism includes at least one or more insert tabs of the first insert flange locking into at least one or more slots of the first spool flange and at least one or more insert tabs of the second insert flange locking into at least one or more slots of the second spool flange.

5. The reel of claim 1, wherein an exterior surface of the cylindrical hub forms a barrel surface for receipt of a wire for winding thereon.

6. The industrial reel of claim 1, wherein the at least one or more castellations of the first and the second insert create an alignment feature to lock the first and the second inserts into each other.

7. The industrial reel of claim 6, wherein the at least one or more castellations of the first and the second insert comprise a series of recessed castellations and a series of extending castellations.

8. The industrial reel of claim 7, wherein the recessed castellations of the first insert are configured to be aligned with the extending castellations of the second insert, and the recessed castellations of the second insert are configured to be aligned with the extending castellations of the first insert.

9. The industrial reel of claim 8, wherein the first and the second inserts are locked into each other and extend through an interior surface of the cylindrical hub.

10. The industrial reel of claim 1, wherein the first and the second spool flange each further comprise at least one or more ribs protruding from the sidewall of the first and the second spool flange and extending to the inner surface of the first and the second spool flange.

11. The industrial reel of claim 10, wherein the at least one or more slots are positioned at locations on the sidewall of the first and the second spool flange that are different from locations where the at least one or more ribs protrude from the sidewall.

12. The industrial reel of claim 11, wherein the at least one or more ribs prevent the at least one or more insert tabs of the first and the second insert from snapping into the spool except in the at least one or more slots of the first and the second spool flange.

13. A locking system for an industrial reel, the locking system comprising:

a spool comprising a cylindrical hub, a first spool flange positioned at a first end of the cylindrical hub and a second spool flange positioned at a second end of the cylindrical hub, the first spool flange and the second spool flange projecting radially from the cylindrical hub; and a first insert and a second insert removably affixable to the first spool flange and the second spool flange respectively, the first insert and the second insert each comprising:

a cylindrical barrel having a first longitudinal end and a second longitudinal end, wherein the second longitudinal end includes at least one or more castellations; and an insert flange extending from the first longitudinal end of the cylindrical barrel, wherein the insert flange is removably affixable on a radially outward edge thereof to a radially outward edge of the first spool flange;

wherein the radially outward edge of the first spool flange and the radially outward edge of the second spool flange each comprise a sidewall that is perpendicular to an inner surface of the first spool flange and the second spool flange;

wherein the spool further comprises at least one or more slots positioned within the sidewall of the first spool flange and the second spool flange; and wherein the radially outward edge of the first insert flange and the radially outward edge of the second insert flange each comprise at least one or more insert tabs configured to interlock with the one or more slots.

14. The locking system of claim 13, wherein the first cylindrical barrel of the first insert and the second cylindrical barrel of the second insert are partial barrels.

15. The locking system of claim 13, wherein the reel further comprises a locking mechanism.

16. The locking system of claim 15, wherein the locking mechanism includes at least one or more insert tabs of the first insert flange locking into at least one or more slots of the first spool flange and at least one or more insert tabs of the second insert flange locking into at least one or more slots of the second spool flange.

17. The locking system of claim 13, wherein an exterior surface of the cylindrical hub forms a barrel surface for receipt of a wire for winding thereon.

18. The locking system of claim 13, wherein the at least one or more castellations of the first and the second insert create an alignment feature to lock the first and the second inserts into each other.

19. The locking system of claim 18, wherein the at least one or more castellations of the first and the second insert comprise a series of recessed castellations and a series of extending castellations.

20. The locking system of claim 19, wherein the recessed castellations of the first insert are configured to be aligned with the extending castellations of the second insert, and the recessed castellations of the second insert are configured to be aligned with the extending castellations of the first insert.

21. The locking system of claim 20, wherein the first and the second inserts are locked into each other and extend through an interior surface of the cylindrical hub.

22. The locking system of claim 13, wherein the first and the second spool flange each further comprise at least one or more ribs protruding from the sidewall of the first and the second spool flange and extending to the inner surface of the first and the second spool flange.

23. The locking system of claim 22, wherein the at least one or more slots are positioned at locations on the sidewall of the first and the second spool flange that are different from locations where the at least one or more ribs protrude from the sidewall.

24. The locking system of claim 23, wherein the at least one or more ribs prevent the at least one or more insert tabs of the first and the second insert from snapping into the spool except in the at least one or more slots of the first and the second spool flange.

25. A method for locking and unlocking an industrial reel, the method comprising:

providing a spool comprising a cylindrical hub, a first spool flange positioned at a first end of the cylindrical hub and a second spool flange positioned at a second end of the cylindrical hub, the first spool flange and the second spool flange projecting radially from the cylindrical hub;

providing at least one first insert removably affixable to the first spool flange, the at least one first insert comprising:

a first cylindrical barrel having a first longitudinal end and a second longitudinal end, wherein the second longitudinal end includes at least one or more castellations; and a first insert flange extending from the first longitudinal end of the first cylindrical barrel, wherein the first insert flange is removably affixable on a radially outward edge thereof to a radially outward edge of the first spool flange; and providing a second insert removably affixable to the second spool flange, the second insert comprising:

a second cylindrical barrel having a first longitudinal end and a second longitudinal end, wherein the second longitudinal end includes at least one or more castellations; and a second insert flange extending from the first longitudinal end of the second cylindrical barrel, wherein the second insert flange is removably affixable on a radially outward edge thereof to a radially outward edge of the second spool flange;

wherein the radially outward edge of the first spool flange and the radially outward edge of the second spool flange each comprise a sidewall that is perpendicular to an inner surface of the first spool flange and the second spool flange, and wherein the spool further comprises at least one or more slots positioned within the sidewall of the first spool flange and the second spool flange, and wherein the radially outward edge of the first insert flange and the radially outward edge of the second insert flange each comprise at least one or more insert tabs configured to interlock with the one or more slots;

locking at least one or more insert tabs of the first insert flange into at least one or more slots of the first spool flange.

26. The method of claim 25, further comprising locking at least one or more insert tabs of the second insert flange into at least one or more slots of the second spool flange.

27. The method of claim 25, further comprising aligning the at least one or more castellations of the first and the second insert into each other.

* * * * *